United States Patent [19]

Courvoisier et al.

[11] Patent Number: 4,587,747

[45] Date of Patent: May 13, 1986

[54] SKI BOOT INTO WHICH THE FOOT IS INTRODUCED FROM THE REAR

[75] Inventors: Guy Courvoisier; Simon Arieh, both of Geneva, Switzerland

[73] Assignee: Lange International S.A., Fribourg, Switzerland

[21] Appl. No.: 668,267

[22] Filed: Nov. 5, 1984

[30] Foreign Application Priority Data

Nov. 11, 1983 [CH] Switzerland ..... 6092/83

[51] Int. Cl.[4] ..... A43B 5/04

[52] U.S. Cl. ..... 36/117; 36/105; 36/120

[58] Field of Search ..... 36/117-121, 36/105

[56] References Cited

U.S. PATENT DOCUMENTS

| | | | |
|---|---|---|---|
| 3,803,730 | 4/1974 | Hanson . | |
| 4,154,009 | 5/1979 | Kubelka et al. | 36/119 |
| 4,265,034 | 5/1981 | Salomon | 36/121 |

FOREIGN PATENT DOCUMENTS

| | | | |
|---|---|---|---|
| 0053340 | 11/1981 | European Pat. Off. . | |
| 2441913 | 4/1976 | Fed. Rep. of Germany | 36/120 |
| 2607698 | 8/1977 | Fed. Rep. of Germany | 36/120 |
| 2358119 | 2/1978 | France . | |
| 2475863 | 8/1981 | France | 36/119 |
| 471552 | 6/1969 | Switzerland | 36/117 |

*Primary Examiner*—James Kee Chi

*Attorney, Agent, or Firm*—Brumbaugh, Graves, Donohue & Raymond

[57] ABSTRACT

A ski boot with rear entry including a rigid shell integrally formed with a front part of an upper, opened towards the rear throughout its height and of a sort to be closed by a shield articulated on the boot in such a way as to be provided with at least two degrees of freedom, which permits every movement thereof, albeit limited, both in rotation and in translation in a substantially vertical plane, when the fastening means are in a closed position. It is possible, hence, to ensure the best possible fitting of the shield to the shape of the ankle and of the lower part of the calf. The shield may be articulated on the boot through its lower end in such a way as to permit play.

11 Claims, 16 Drawing Figures

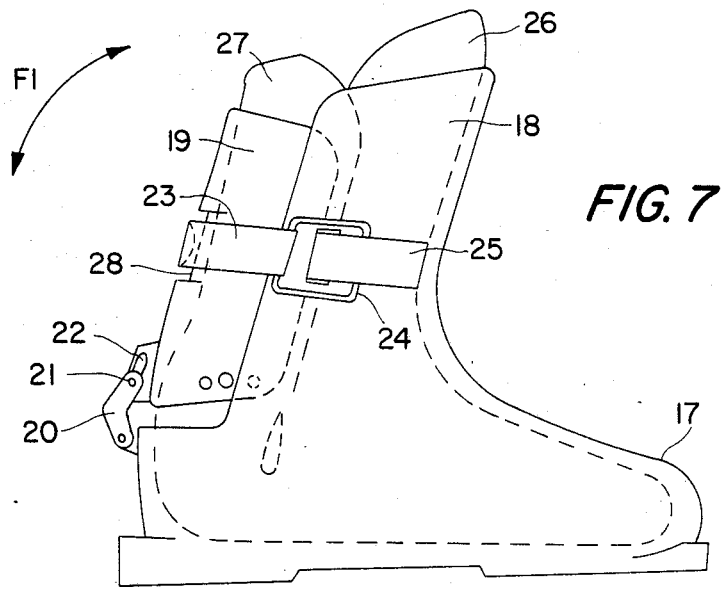
FIG. 7
FIG. 8
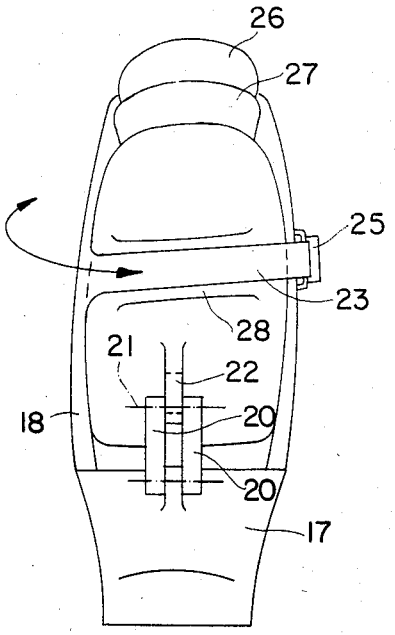
FIG. 9
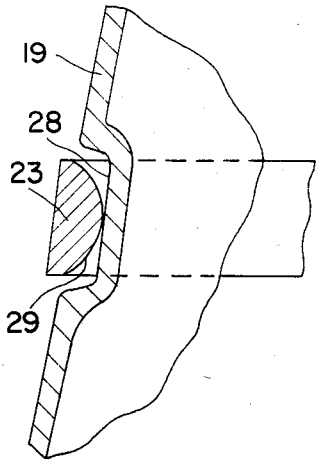

FIG. 10
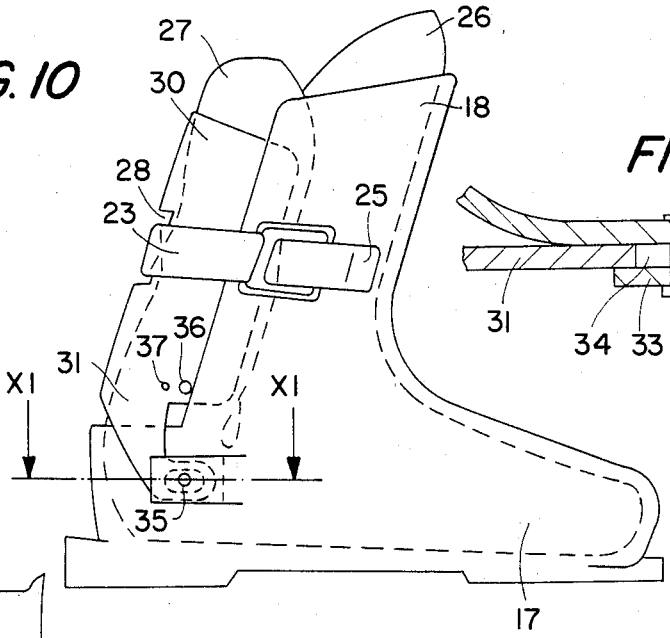
FIG. 11
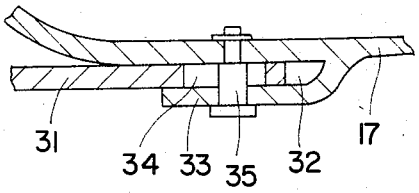
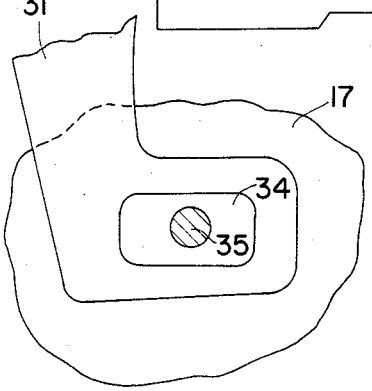
FIG. 12
FIG. 13
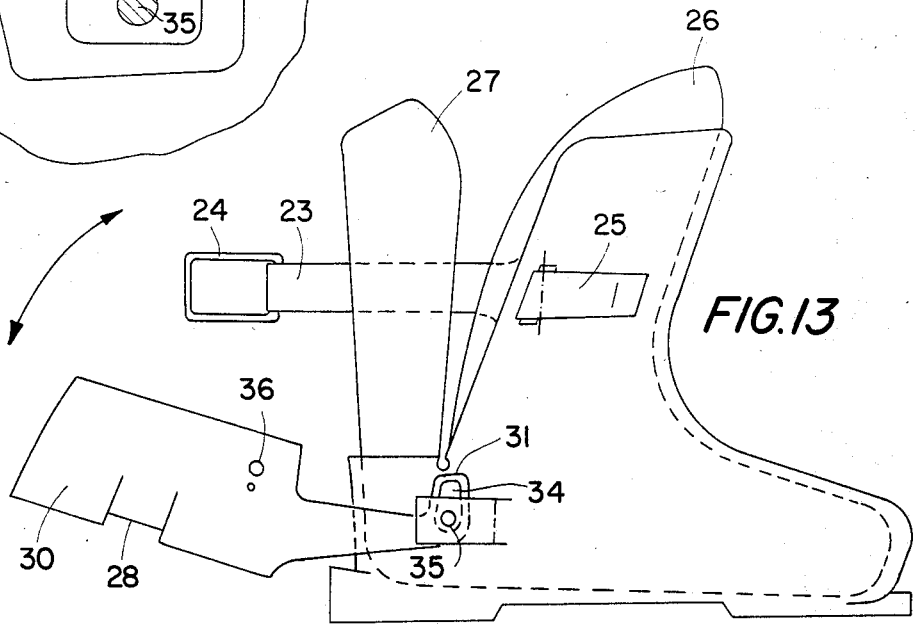

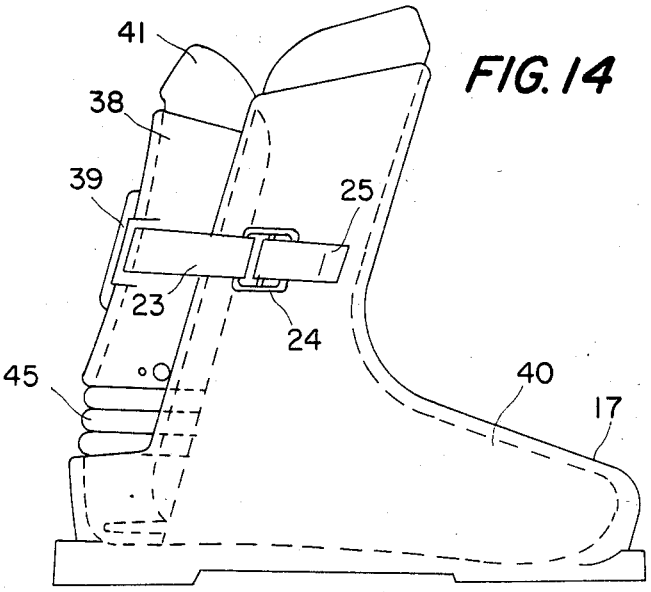
FIG. 14
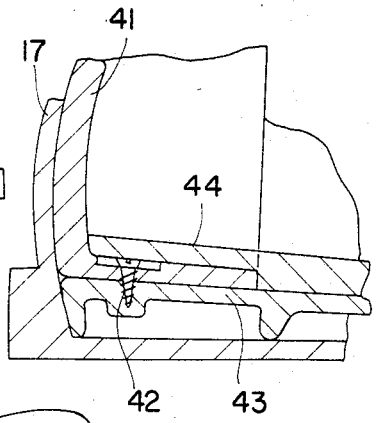
FIG. 16
FIG. 15
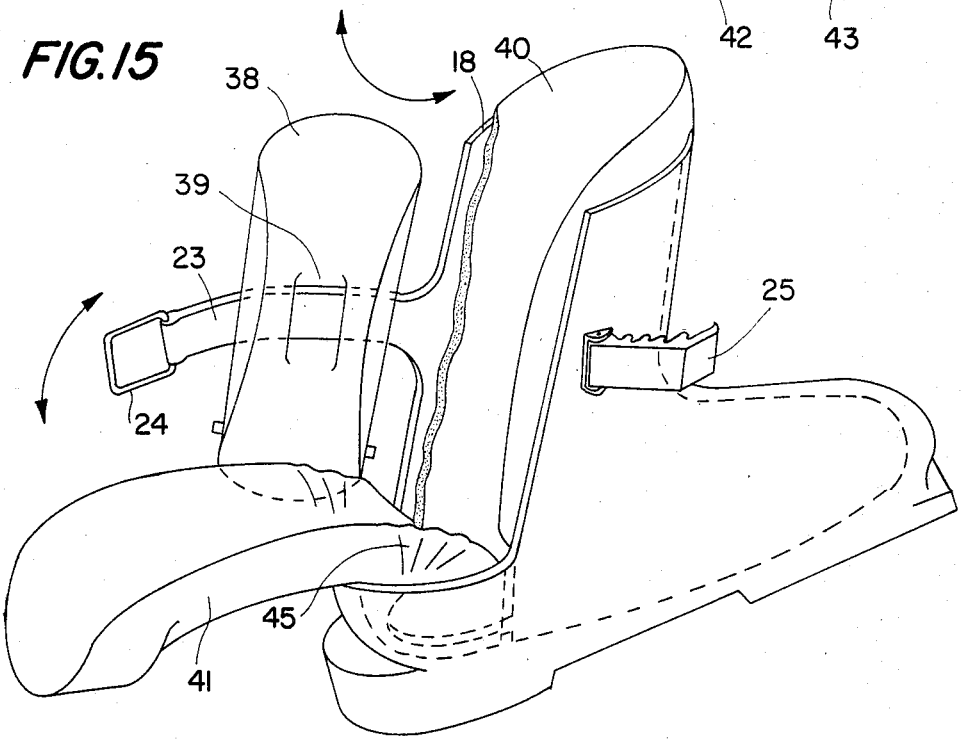

SKI BOOT INTO WHICH THE FOOT IS INTRODUCED FROM THE REAR

FIELD OF INVENTION

The present invention relates to a ski boot into which the foot is introduced from the rear, comprising a rigid shell designed to fit around the foot, the heel and the lower fore-part of the ankle, and an upper or leg consisting both of a front part in the form of a gutter-section, opened towards the rear and integral with the said shell, and of a rear part in the form of a gutter-section, articulated upon the boot and arranged so as to be housed within the said front part, thus forming an oversleeve designed to encompass the ankle, and means for fastening the said oversleeve in a closed position.

PRIOR ART

Several embodiments of this type of boot have been proposed to date. They all have in common the characteristic that the rear part of the oversleeve is connected, in an articulated manner, by its lower extremity to the shell, about a fixed axis. In the Patent Specification No. FR 2 428 413, the rear part of the oversleeve, named rear shield or cap, is articulated upon the shell about a fixed axis in each malleolar area. This is the case also for the boot described in the Patent Application No. EP 0.053.340. Equally known in the prior art is a monoshell boot of which the shell has, on the rear part thereof, a wide vertical slit extending to the full height of this shell and closed, through a tongue articulated at the base of the shell, by means of an elongated flap or extension formed so as to be continuous with this tongue (U.S. Pat. No. 3,803,730). This form of articulated connection, indeed, allows a certain flexibility for the positioning of the tongue, but owing to the narrowness of the slit in the shell, the boot concerned presents difficulties in permitting the foot to be effectively introduced therein from the rear. It has also been proposed to articulate the oversleeve within the sole through a supple part connected to a shaped part (FR-A-2.358.119).

In consideration of the articulation points of the shield, or respectively of the tongue, in these boots of the prior art it is difficult to fit the shield well and comfortably to the leg, since, when this shield is closed and tightened against the leg, either through the lower part of this shield, pressure is brought to bear painfully upon the Achilles tendon, or there remains a space between this lower part of the shield and the ankle, with the result that the foot-holding function proves insufficient, hence preventing the related ski from functioning perfectly. Furthermore, the opening of the shield by tilting this to the rear is limited through factors of structure and of use in snow, with the result that there is not achieved here what is truly described as the introduction of the foot from the rear, but a facility in introducing this from the top of the boot.

SUMMARY OF THE INVENTION

The present invention provides a ski boot with rear entry achieving as good a fitting as possible of the articulated rear part of the oversleeve to the leg.

To this end, the ski boot according to the invention is characterised in that the said rear part of the upper is articulated on the boot through a connection allowing at least two degrees of freedom for this rear part, and thus permitting every movement, albeit limited, in rotation or in translation, in a substantially vertical plane parallel to the direction of the foot, this, in a position where the fastening means are closed.

The pivoting axis does not occupy a fixed position, either on the articulated rear part, or in relation to the shell. This freedom of movement permits the rear part of the upper to be fitted to the shape of both ankle and calf, and to bear with almost uniform pressure upon the leg. In addition, the method of articulation concerned permits the rear part of the boot to be fully loosened that is to say, hence offering the possibility of introducing the foot therein from the rear, in the true sense of the term.

The rear part of the upper may be articulated, either laterally on the front part by means of a flexible connection, or by the lower extremity thereof through means ensuring at least two degrees of freedom, such as a small rod with axial play or an articulation around two pivots with sufficient play in all directions.

The invention will be better understood when the following description is read in connection with the accompanying drawings.

DESCRIPTION OF THE DRAWINGS

FIG. 7 is a side view of a second form of embodiment.

FIG. 8 is a rear view of this second form of embodiment.

FIG. 9 represents a detail of this second form of embodiment.

FIG. 10 is a side view of a third form of embodiment.

FIG. 11 is a sectional view of a detail shown along a line XI—XI in FIG. 10.

FIG. 12 is a view of a detail of this third form of embodiment.

FIG. 13 is a view of this third form of embodiment in an opened state.

FIG. 14 represents a fourth form of embodiment.

FIG. 15 is a perspective view of this fourth form of embodiment in an opened state, and FIG. 16 is a sectional view of the heel part of this fourth form of embodiment.

DESCRIPTION OF THE PREFERRED EMBODIMENTS

Figure 4:
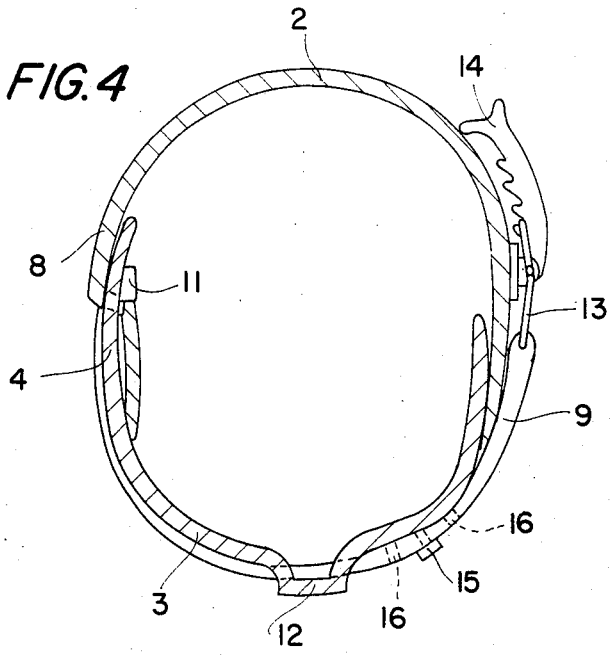
FIG. 4 is a horizontal sectional view of the boot, as shown in FIG. 1, at the level of the fastening loop or buckle.
Figure 6:
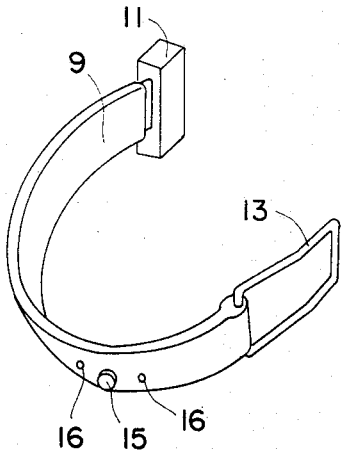
FIG. 6 represents the fastening band.
Figure 5:
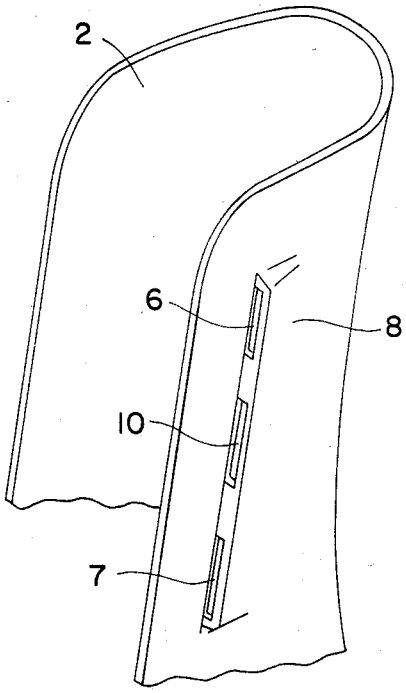
FIG. 5 represents a detail of the upper, showing the anchoring means on the rear part of this upper and means thereon for anchoring the fastening band.

The boot represented in FIGS. 1 to 6 is a boot of the monoshell type, of which the shell, made in semi-rigid synthetic material, for example, polyurethane, consists of a lower part 1 fitting around the foot and the heel and comprising the sole, and of an upright part 2 constituting the front part of the upper of the boot. This part 2 is in the form of a gutter-section opened towards the rear, and on the part 2 is articulated a part 3, in the same material as that of the shell 1, equally in the form of a gutter-section, and designed to be housed within the front prt 2 so as to form a type of oversleeve designed to encompass the ankle and the lower part of the leg. The rear part 3 is articulated with the front part 2 by means of two lateral elongated flaps passing freely through two vertical slits 6 and 7 formed within a reinforced thickness 8 of the part 2 (FIG. 5). The part 3 is fastened in a closed position by means of a band 9. This band 9 passes through a vertical slit 10 similar to the slits 6 and 7 and positioned between the latter. It is fixed onto the part 2 by means of a check-bolt 11. It passes through a keeper guide 12, approximately in the middle of the rear part 3, and it has, at its other end, a loop 13 cooperating with a tightening lever or catch 14 articulated on the part 2. In order to prevent displacement of the rear part 3 along the band 9, the latter is fixed by means of a hole onto a metal locking stud 15 riveted onto the part 3. There are several holes 16 made in the band 9, which permit this band 9 of the part 3 to be adjusted in whatever position is appropriate.

Figure 1:
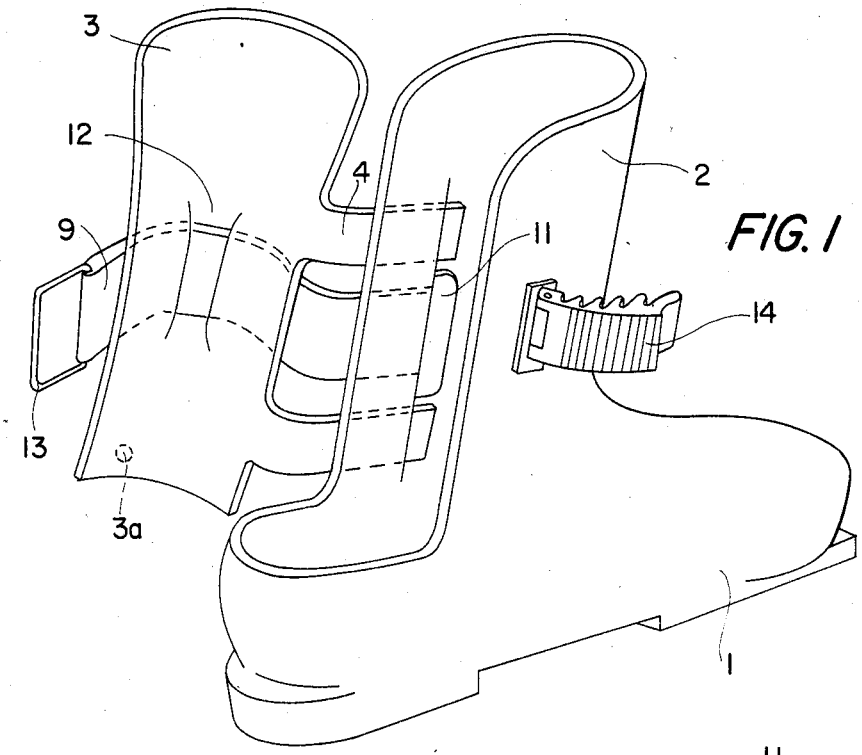
FIG. 1 represents a perspective view of an opened boot, according to a first form of embodiment, without the inner lining-shoe.
Figure 2:
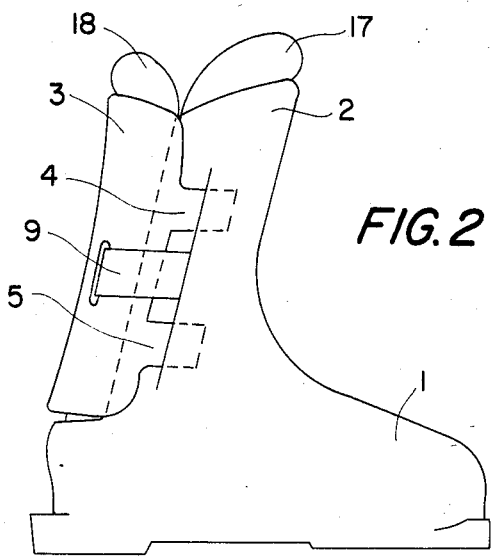
FIG. 2 is a view of the closed boot, seen from the inner side of the leg.
Figure 3:
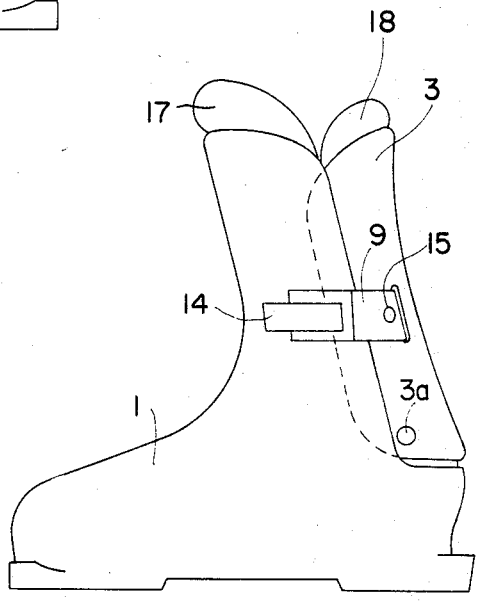
FIG. 3 shows the closed boot, viewed from the outer side of the leg.

The boot comprises, furthermore, an inner lining-shoe which is not shown in FIGS. 1, 4 and 5, but can be seen in FIGS. 2 and 3, and which comprises a fixed part 17 fitted around the foot and the ankle similarly to the parts 1 and 2 of the boot shell, and a rear part 18 which can be tilted back towards the rear. This lining-shoe is made in a compressible material and includes a waterproof outer jacket. In a closed position, as represented in FIGS. 2, 3 and 4, the rear part 3 of the upper is arranged so as to be housed within the front part 2 and brought to bear upon the part 18 of the lining-shoe. In this position, the part 3 may be slightly displaced in nearly every direction, that is to say, equally about an axis parallel to the direction of the foot, by virtue of the supple nature of the elongated tongue-flaps 4 and 5, so as to ensure its correct fitting to the shape of the leg. In the movement required to ensure this correct fitting, the small elongated flaps 4 and 5 slide through the slits 6 and 7.

When the skier straightens a leg or bends this slightly backwards in relation to the sole of the foot, the part 3 has a tendency to turn on its pivot in a clockwise direction, as in FIG. 3. So as to restrict this movement, which would tend to compress the Achilles tendon through a levering effect, there is provided a stop 3*a* on the part 3, which stop is made to abut against the edge of the fixed front part 2.

In alternative embodiments, the fastening band could be replaced by any other device known to the prior art, such as the loops currently used on ski boots. In this case, the articulation flaps 4 and 5 are equipped with a check-bolt comparable with the check-bolt 11 of the band.

A second form of embodiment is represented in FIGS. 7 to 9. The boot against consists of a shell 17 formed continuously with a front part 18 of the upper in the form of a gutter-section. The pivoting rear part 19 is here articulated on the heel of the shell 17 by means of a small rod 20 with two arms, of which the upper axis 21 is articulated within a port 22 on the lower portion of the part 19. The oversleeve formed by the parts 18 and 19 is also closed by means of a band 23 being continuous with the front part 18 of the shell. This band is equipped with a loop 24 which cooperates with a tightening lever 25 comparable with the lever 14. Within the shell 17 is fitted an inner lining-shoe 26 split from top to bottom so as to have a rear part 27 upon which is brought to bear the shield 19, and being of a sort which can be tilted back towards the rear when the shield 19 is opened. At the place through which the band 23 passes, there is formed in the shield 19 is a hollow 28 of rectangular section, in the bottom of which the band 23 is supported by means of a convex part 29 which permits the shield 19 to rotate easily in the plane shown in the drawing, as indicated by the arrow F1, while bearing upon the convex part 29, which movement is allowed by the small rod 20, the port, furthermore, permitting displacement in translation up and down or inversely, with the result that the shield 19 is permitted to take up independently the position that ensures the best possible fitting to the leg. The articulation permitted by means of the small rod 20 also allows the shield 19 to be fully tilted back towards the rear, which thus permits the foot to be introduced into the boot from the rear, in the true sense of the term.

A third form of embodiment is represented in FIGS. 10 to 13. The boot shell consists of the same parts 17 and 18 as in the preceding form of embodiment. This boot is fitted with a rear shield 30, which differs from the shield 19 of the preceding embodiment only in the method whereby it is articulated on the shell 17. This articulation here comprises two lateral shaped extensions 31, which extend the shield downwards on each side of the heel. The elbow end of each of these extensions 31 is engaged within a housing 32 formed between the shell 17 and a side plate 33 which is integral with the shell. Each of these end pieces incorporates a port 34 through which passes an axis pin 35, the size of the port 34 being such that the articulation allows play in all directions in a plane being perpendicular to the axis pin 35, as is clearly discernible from FIG. 12. The shield 30 also comprises, on each side thereof, a stop 36 arranged so as to abut against the edges of the front part 18 thus preventing any excessive rearwards tilting of the shield 30. Each of these stops 36 consists of a removable pin which may be fixed in another hole 37 in such a way as to allow any adjustment of the stops. Regarding the remaining components, the shield and its fastening device are identical with those of the second form of embodiment, the same parts here being designated with the same references. The boot also comprises an inner lining-shoe in two parts 26,27, comparable with that of the preceding form of embodiment. For the opening of the boot, the shield 30 is tilted towards the rear about the axes 35, as shown in FIG. 13. The articulation play about the axes 35, as shown in FIG. 13, allows the shield 30 sufficient freedom to ensure the best possible fitting thereof, naturally, to the shape of the leg.

A fourth form of embodiment is represented in FIGS. 14 to 16. The boot shell again consists of the same parts 17 and 18 as in the preceding forms of embodiment. The pivoting shield 38, constituting the rear part of the oversleeve, is here articulated on the front part 18 directly by means of the band 23 which passes through a keeper guide 39 at the back of the shield 38. This shield may or may not be fitted with a check-bolt designed to prevent it from sliding freely along the band 23. The shell 17 encases a lining-shoe 40 designed to ensure a comfortable protective fit, opened at the rear throughout its height and closable by means of a tongue 41 made in flexible elastic injected synthetic material, for example, polyurethane, this tongue 41 having a lower part being elbow-shaped and fixed, by means of a screw 42, either to a wedge piece 43 occupying the base of the boot or directly to the shell. The screw 42 is covered by a protective sole 44. Immediately above the part of the shell 17, which fits around the heel, the tongue 41 includes a concertina-like gusset 45 providing this part with the flexibility required to ensure both its correct fitting to the leg and the possibility of its being tilted or folded back towards the rear (FIG. 15) to permit introduction of the foot. The shield 38 is brought to bear upon the tongue 41, so as to fit this against the leg. As may be seen in FIG. 1, the band 23 passes through the keeper guide 39 of the shield with both vertical and horizontal play, which permits the shield to be slightly displaced in translation as well as in rotation. For introduction of the foot, the shield 38 may be completely pushed back to one side and the tongue, fully tilted or folded backwards, thus entirely opening up the access to the inner lining-shoe 40, that is to say, permitting the foot to be introduced into the boot from the rear, in the true sense of the term.

All the forms of embodiment described herein could comprise a front part of the oversleeve 2, or respectively 18, being articulated on the shell in each malleolar area.

What is claimed is:

1. A ski boot into which the foot is introduced from the rear, comprising a rigid shell designed to fit around the foot, the heel and the lower fore-part of the ankle, and an upper or leg consisting of a front part in the form of a gutter-section, opened towards the rear and integral with the said shell, and of a rear part in the form of a gutter-section, articulated upon the boot and arranged so as to be housed within said front part, thus forming an oversleeve designed to encompass the ankle, means for fastening said oversleeve in a closed position, and connection means articulating said rear part of the upper on the boot for allowing at least two degrees of freedom for this rear part, and thus permitting every movement, albeit limited, in rotation or in translation, in a substantially vertical plane parallel to the direction of the foot with the fastening means closed.

2. A ski boot according to claim 2, wherein said rear part is laterally articulated on the front part of the upper by means of a strip or band of flexible non-extensible material.

3. A ski boot according to claim 1, wherein said rear part is articulated on the heel of the shell by means of a small rod with axial play.

4. A ski boot according to claim 1, wherein said rear part is articulated on either side of the shell, in each malleolar area, at an axis point about which play is permitted in every direction for the articulated joint.

5. A ski boot according to claim 1, wherein said articulated rear part has, near its lower end and at least on one side, a stop designed to limit the rotation of the lower part of the said articulated rear part in the direction of the foot.

6. A ski boot according to claim 1, wherein the means for fastening the oversleeve consist of a band linking the two sides of the front part of the upper and fitted with clasping means or a catch cooperating with tightening means.

7. A ski boot according to claim 1, wherein said rear part is articulated laterally on the front part by means of a fastening band or strap cooperating with a tightening means fixed upon the other side of the front part.

8. A ski boot according to claim 7, wherein said band or strap is formed so as to be continuous with the front part, and in that the said rear part is slidably mounted upon this band or strap.

9. A ski boot according to claim 1, comprising an inner lining-shoe in two parts, one of which is capable of being pushed back towards the rear so as to permit the foot to be introduced from the rear, wherein the deflectable rear part of the lining-shoe is made in a flexible elastic injectable synthetic material, and in that the said rear part of the upper is brought to bear upon this part of the lining-shoe.

10. A ski boot according to claim 9, wherein said deflectable part of the inner lining-shoe is rigidly attached to the fixed part of the boot, and in that this oncludes a concertina-like gusset serving as an articulation at the level of the malleolar area.

11. A ski boot according to claim 1, wherein said front part is articulated on the shell in the malleolar area.

* * * * *

UNITED STATES PATENT AND TRADEMARK OFFICE

CERTIFICATE OF CORRECTION

PATENT NO. : 4,587,747

DATED : May 13, 1986

INVENTOR(S) : Courvoisier et al.

It is certified that error appears in the above-identified patent and that said Letters Patent is hereby corrected as shown below:

First page, 2nd col., 4th line, "8/1977" should read --9/1977--.

Col. 3, line 1, "prt" should read --part--;
line 54, "against" should read --again--.

Col. 5, line 39, "claim 2" should read --claim 1--.

Col. 6, line 37, "oncludes" should read --includes--.

Signed and Sealed this

*Sixteenth* Day of *September 1986*

[SEAL]

*Attest:*

DONALD J. QUIGG

*Attesting Officer*

*Commissioner of Patents and Trademarks*